US007207829B2

(12) United States Patent
Ono et al.

(10) Patent No.: US 7,207,829 B2
(45) Date of Patent: Apr. 24, 2007

(54) ELECTRIC CONNECTOR

(75) Inventors: Yasuhiro Ono, Tokyo (JP); Akiyoshi Oshitani, Saitama (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/288,260

(22) Filed: Nov. 29, 2005

(65) Prior Publication Data

US 2006/0116020 A1 Jun. 1, 2006

(30) Foreign Application Priority Data

Nov. 30, 2004 (JP) ..... 2004-345426
Dec. 17, 2004 (JP) ..... 2004-365746

(51) Int. Cl.
*H01R 4/24* (2006.01)

(52) U.S. Cl. ..... 439/417

(58) Field of Classification Search ..... 439/417, 439/425, 495, 660, 404, 409, 459
See application file for complete search history.

(56) References Cited

U.S. PATENT DOCUMENTS 4,460,228 A * 7/1984 Lane et al. ..... 439/409
6,250,959 B1 * 6/2001 Yamaguchi et al. ..... 439/578
6,280,242 B1 * 8/2001 Jochen et al. ..... 439/497

FOREIGN PATENT DOCUMENTS

JP 11-345640 A 12/1999

* cited by examiner

*Primary Examiner*—Phuong Dinh
(74) *Attorney, Agent, or Firm*—Morgan, Lewis & Bockius LLP

(57) ABSTRACT

A plug member includes a plug body formed with a groove, and a plurality of plug contacts, which include contact pieces which are opposed to each other and fitted into a socket body. The contact pieces are disposed in the groove and on an outer face of a side wall of the plug body. A plurality of core conductors covered with an insulating sheath include a portion adapted to be inserted into the groove. A pressing member has a first part attached to the plug body such that the first part is inserted into the groove, thereby pressing the portion of the wiring member against one contact piece. The contact pieces are resiliently deformable, so that a first blade portion bites into the corresponding core conductor in the portion of the wiring member, and the portion of the wiring member is resiliently clamped between one contact piece and the first part of the pressing member.

12 Claims, 11 Drawing Sheets

ELECTRIC CONNECTOR

BACKGROUND OF THE INVENTION

This invention relates to an electric connector suitably used for electrically connecting insulating sheathed cables in a press-contact manner.

Insulating sheathed cables (hereinafter referred to as "cables"), each having a core conductor composed of a plurality of wire elements twisted together and covered with an insulating sheath, have been extensively used as wiring members in electronic equipments, which have now been formed into a more compact design and a thinner design. In Japanese Patent Publication No. 11-345640A, there is proposed a configuration for connecting such cables, in which an electric connector electrically connects a plurality of cables in a press-contact manner collectively without the use of solder.

In the configuration disclosed in the above publication, a lid-shaped pressing member is pivotably supported on a housing. This pressing member has a pressing portion adapted to collectively press blade portions of contacts against cables inserted into an opening formed at one side of the housing, so that the respective cables can be electrically connected with the corresponding contacts at once, and efficiency in the connection process can be enhanced.

In electronic equipments which have been more and more advanced with respect to a compact design and a high-density design, it has now been required to achieve a space-saving design with respect to an area of mounting of an electric connector used for connecting the cables to a circuit board such as a printed circuit board, that is, to save the connector mounting area on the circuit board. Therefore, it is desired that the electric connector should be of such a form as to meet this requirement and also to enhance the connecting reliability.

In the configuration described in the above publication, an edge of the blade portion of each contact may extend either in a direction intersecting the cable or in a direction parallel to the cable. However, in the former case, when the blade edge bites into a sheath of the cable to come into contact with the core conductor, the blade edge may excessively bite into the core conductor particularly when a high pressing force is applied with a view to obtaining the positive contact condition, and as a result there is a possibility that the blade edge damages the core conductor (or severs the core conductor when the degree of the biting is excessive), so that the connecting performance is adversely affected. On the other hand, in the latter case, the blade edge is liable to slip over the sheath of the cable having an arcuate outer periphery sideward during the cable connecting operation. Particularly when the rigid sheath material is used in order to increase the strength of the cable, the blade edge is more liable to slip, so that the blade edge fails to bite into the center of the core conductor, which leads to a possibility that the blade portion fails to be positively connected with the core conductor.

In addition, the connector disclosed in the above publication comprises a connecting portion adapted to be fitted with a mating connector. This connecting portion is formed as an extended part of the contact having the blade portion. In a case where the connector is mounted on a circuit board so that the connecting portion extends in parallel with the face of the circuit board, a space required for mounting the connector and the mating connector extends widely in the lateral direction. Accordingly, it is difficult to achieve a space-saving design.

SUMMARY OF THE INVENTION

It is therefore an object of this invention to provide an electric connector which can achieve a space-saving design with respect to a mounting area, and a high reliability of connection to cables.

In order to achieve the above object, according to the invention, there is provided an electric connector, comprising:

a plug member, adapted to be fitted into a socket body in a first direction, the plug member comprising:

a plug body, formed with a groove extending in a second direction which is perpendicular to the first direction; and a plurality of plug contacts, each of which includes a first contact piece and a second contact piece which are opposed to each other with a gap therebetween, and a first blade portion extended from the first contact piece so as to oppose to the second contact piece, the plug contacts being arrayed in the second direction such that the first contact piece is disposed in the groove and the second contact piece is disposed on an outer face of a side wall of the plug body to be electrically connected with the socket body;

a wiring member, in which a plurality of core conductors arrayed in the second direction and covered with an insulating sheath, the wiring member including a first portion adapted to be inserted into the groove in the first direction; and a pressing member, having a first part extending in the first direction, and attached to the plug body such that the first part is inserted into the groove, thereby pressing the first portion of the wiring member against the first contact piece in a third direction which is orthogonal to the first direction and the second direction, wherein the first contact piece and the second contact piece are resiliently deformable in the third direction, so that each first blade portion bites into an associated one of the core conductors in the first portion of the wiring member, and the first portion of the wiring member is resiliently clamped between the first contact piece and the first part of the pressing member.

With this configuration, the connecting portion of the plug member for connection to the socket body does not need to extend in the third direction. Therefore, the dimension in the third direction of the electric connector can be reduced, so that a space-saving design for its mounting area can be achieved.

A thickness of the first portion of the wiring member may be reduced.

In this case, the piercing depth of the first blade portion into the insulating sheath of the wiring member can be reduced, and therefore the dimension of the connector in the third direction can be reduced.

The first portion of the wiring member may be formed with slits each of which is adapted to oppose to the first blade portion when the first portion of the wiring member is inserted into the groove.

In this case, since the slit serves to the insertion of the first blade portion, the first blade portion can be easily pierced into the vicinity of the center of the core conductor even when the core conductor is relatively thin, and this contributes to the compact design. And besides, since the first blade portion is pierced into the vicinity of the center of the core conductor, the number of wire elements of the core conductor can be increased.

At least a part of the first portion of the wiring member which opposes to the first blade portion may be made flat.

In this case, when the first blade portion is piercing into the first portion of the wiring member, the distal end of the first blade portion will not be deviated from the proper piercing position, and the first blade portion can be easily pierced into the vicinity of the center of the core conductor even when the core conductor is thin.

The pressing member may have a second part continued from the first part thereof and extending in the third direction. The wiring member may include a second portion adapted to be bent by the second part of the pressing member so as to extend in the third direction.

In this case, the pressing member is less liable to be deformed upon application of an accidental external force such as a bending force although the pressing member is formed of the thin sheet member, which contributes to the achievement of a compact design.

Each first contact piece includes a second blade portion extending in the first direction and adapted to bite into associated one of the core conductors in the second portion of the wiring member.

In this case, the function of holding the wiring member relative to the plug member can be enhanced.

A thickness of the first portion and the second portion of the wiring member may be reduced.

In this case, the dimension of the electric connector in the first

According to the invention, there is also provided an electric connector, comprising:

a plug member, adapted to be fitted into a socket body in a first direction, the plug member comprising:

a plug body, formed with a groove extending in a second direction which is perpendicular to the first direction; and a plurality of plug contacts, each of which includes a first blade portion, the plug contacts being arrayed in the second direction such that each first blade portion is disposed in the groove;

a wiring member, in which a plurality of core conductors arrayed in the second direction and covered with an insulating sheath, the wiring member including a first portion adapted to be inserted into the groove in the first direction; and a pressing member, having a first part extending in the first direction, and attached to the plug body such that the first part is inserted into the groove, thereby pressing the first portion of the wiring member against the first blade portion in a third direction which is orthogonal to the first direction and the second direction, so that each first blade portion bites into an associated one of the core conductors in the first portion of the wiring member, wherein a thickness of the first portion of the wiring member is reduced.

With this configuration, the piercing depth of the first blade portion into the insulating sheath of the wiring member can be reduced, and therefore the dimension of the connector in the third direction can be reduced.

The first portion of the wiring member may be formed with slits each of which is adapted to oppose to the first blade portion when the first portion of the wiring member is inserted into the groove.

In this case, since the slit serves to the insertion of the first blade portion, the first blade portion can be easily pierced into the vicinity of the center of the core conductor even when the core conductor is relatively thin, and this contributes to the compact design. And besides, since the first blade portion is pierced into the vicinity of the center of the core conductor, the number of wire elements of the core conductor can be increased.

At least a part of the first portion of the wiring member which opposes to the first blade portion may be made flat.

In this case, when the first blade portion is piercing into the first portion of the wiring member, the distal end of the first blade portion will not be deviated from the proper piercing position, and the first blade portion can be easily pierced into the vicinity of the center of the core conductor even when the core conductor is thin.

The pressing member may have a second part continued from the first part thereof and extending in the third direction. The wiring member may include a second portion adapted to be bent by the second part of the pressing member so as to extend in the third direction.

In this case, the pressing member is less liable to be deformed upon application of an accidental external force such as a bending force although the pressing member is formed of the thin sheet member, which contributes to the achievement of a compact design.

Each of the plug contacts may include a second blade portion extending in the first direction and adapted to bite into associated one of the core conductors in the second portion of the wiring member.

In this case, the function of holding the wiring member relative to the plug member can be enhanced.

A thickness of the first portion and the second portion of the wiring member may be reduced.

In this case, the dimension of the electric connector in the first direction can be reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

An electric connector according to one embodiment of the present invention will be described below in detail with reference to the accompanying drawings.

Figure 1:
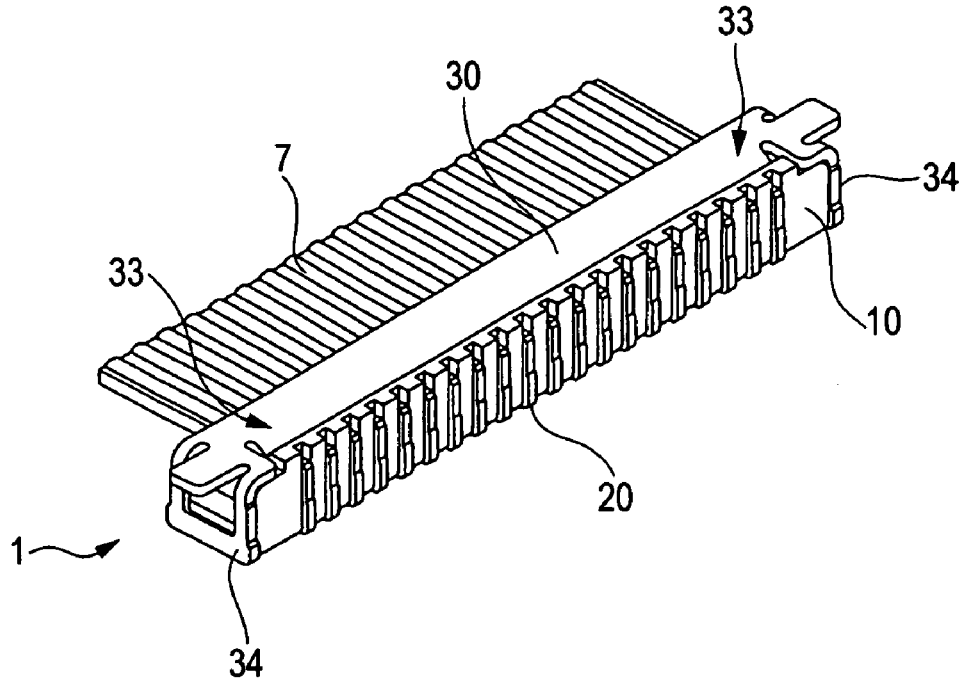
FIG. 1 is a perspective view of a plug body of an electric connector according to one embodiment of the invention.

As shown in FIG. 1, a plug member 1 to which a plurality of cables 7, arranged in a flat manner, are connected includes an elongate plug body 10 of has a generally square cross-sectional shape. A plurality of plug contacts 20 are arranged at a predetermined pitch in a longitudinal direction of the plug body 10. A pressing member 30 has extended pieces 34 extending respectively from opposite longitudinal end portions 33 thereof, and is attached to an upper side of the plug body 10 to partially cover the cables 7.

Figure 2:
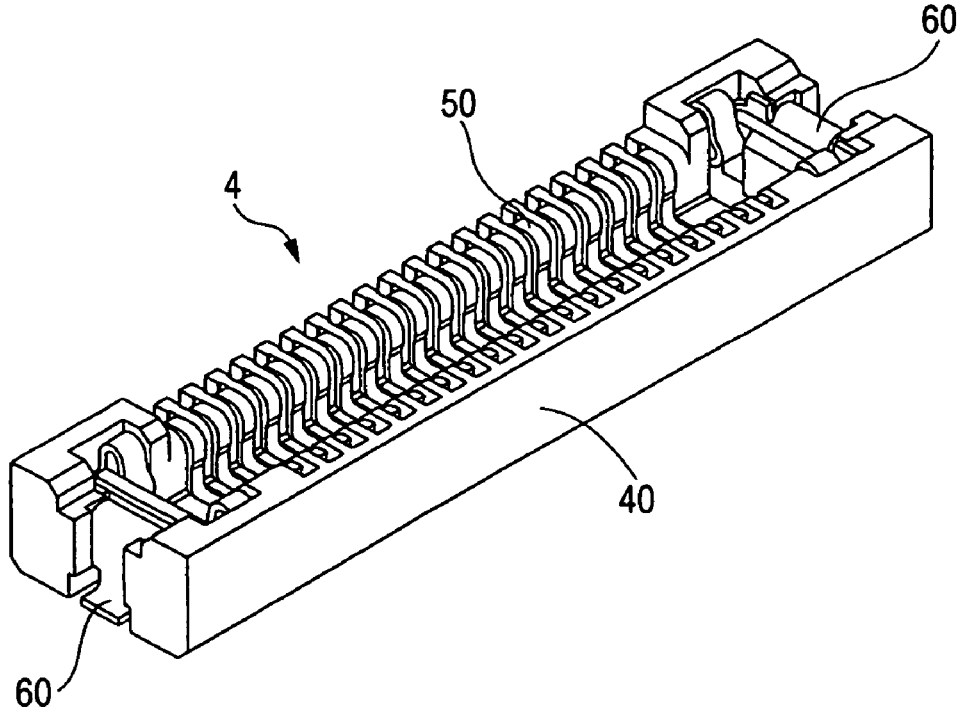
FIG. 2 is a perspective view of a socket body of the electric connector.

As shown in FIG. 2, a socket member 4 includes: an elongate socket body 40 of a generally rectangular cross-sectional shape; a plurality of socket contacts 50 arranged at a predetermined pitch in a longitudinal direction of the socket body 40 in corresponding relation to the arrangement of the plug contacts 20 of the plug member 1; and socket retainers 60 attached respectively to opposite longitudinal ends of the socket body 40 so as to correspond respectively to the extended pieces 34 of the pressing member 30.

Figure 3A:
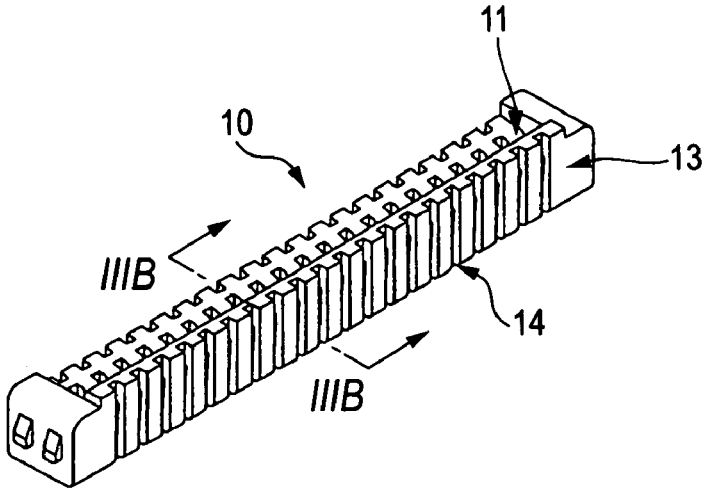
FIG. 3A is a perspective view of the plug body showing a state that a pressing member and plug contacts are removed.
Figure 3B:
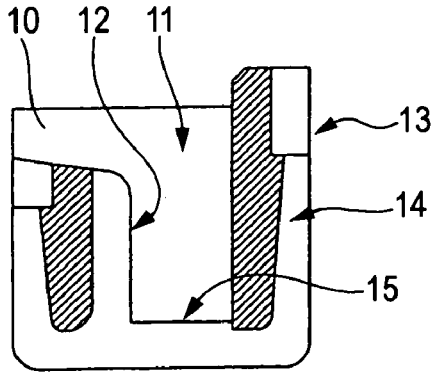
FIG. 3B is a section view taken along a line IIIB—IIIB in FIG. 3A.

As shown in FIGS. 3A and 3B, a groove 11 is formed in the plug body 10 and extends between the vicinities of opposite ends thereof in the longitudinal direction. The groove 11 is open upward such that a bottom 15 of this groove 11 can be viewed from the upper side. Positioning grooves 14 for arranging the plug contacts 20 at the predetermined pitch are formed in an outer face 13 and an inner wall 12 of the plug body 10.

Figure 4:
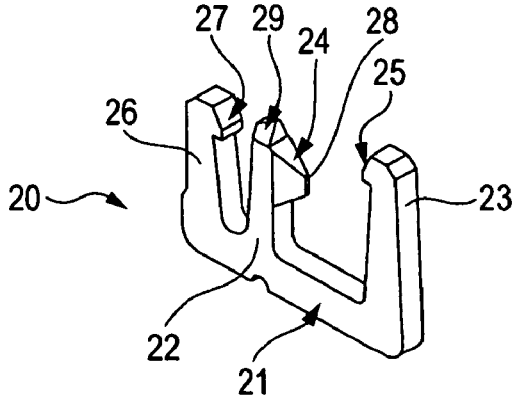
FIG. 4 is a perspective view of one of the plug contacts.

The plug contact 20 is blanked out from a thin metal sheet having good electrical conductivity and spring properties. As shown in FIG. 4, the plug contact 20 includes a beam portion 21 connecting a first piece 22, a second piece 23 and a third piece 26. Projections 24 and 25 are formed respectively at distal ends of the first piece 22 and the second piece 23. When a force is applied to move the projections 24 and 25 away from each other, the first and second pieces 22 and 23 are resiliently deformed away from each other to thereby produce resilient restoration forces respectively for urging the two pieces 22 and 23 toward each other. In addition, a first blade portion 28 is formed on the projection 24 so as to oppose to the second piece 23, and a second blade portion 29 is also formed on the projection 24 so as to extend upward.

Figure 5A:
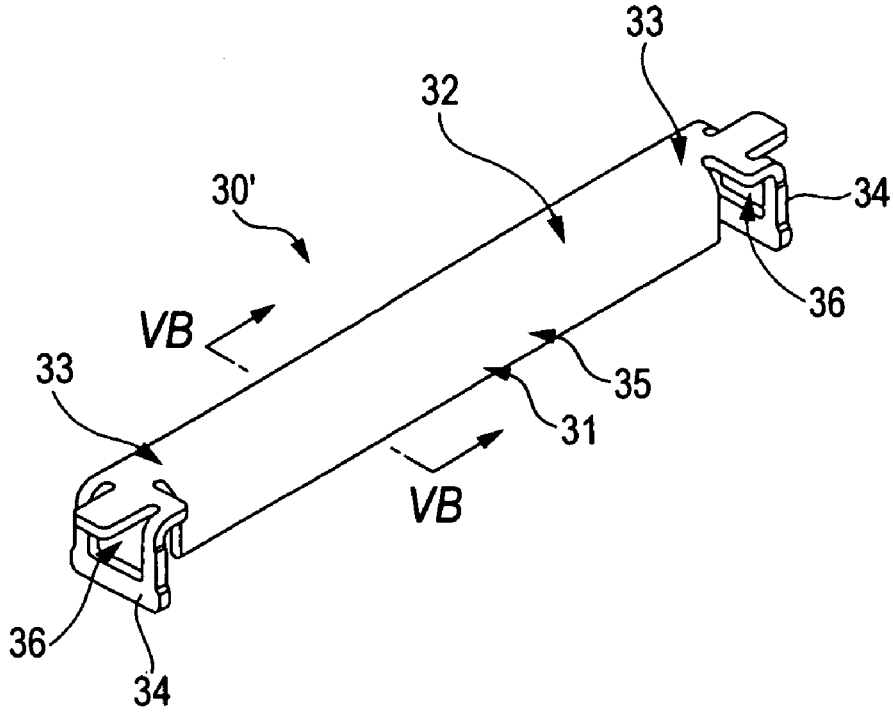
FIG. 5A is a perspective view of the pressing member.
Figure 5B:
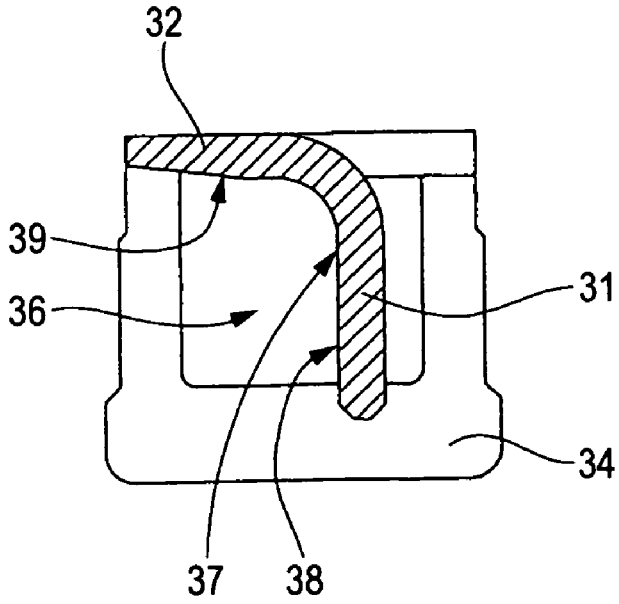
FIG. 5B is a section view taken along a line VB—VB in FIG. 5A.

The pressing member 30 is formed by blanking out from a thin metal sheet having electrical conductivity and then by bending it into a predetermined shape. As shown in FIGS. 5A and 5B, the pressing member 30 includes a laterally-extending portion 32, and a vertically-extending portion 31 extending perpendicularly from the laterally-extending portion 32 such that a vertical face 38 and a horizontal face 39 of an inner face 37 are disposed perpendicular to each other. A length of the vertically-extending portion 31 is slightly smaller than a length of the groove 11 of the plug body 10. The extended pieces 34, each having a window 36, extend downward from the opposite end portions 33 of the laterally-extending portion 32, respectively.

Figure 6:
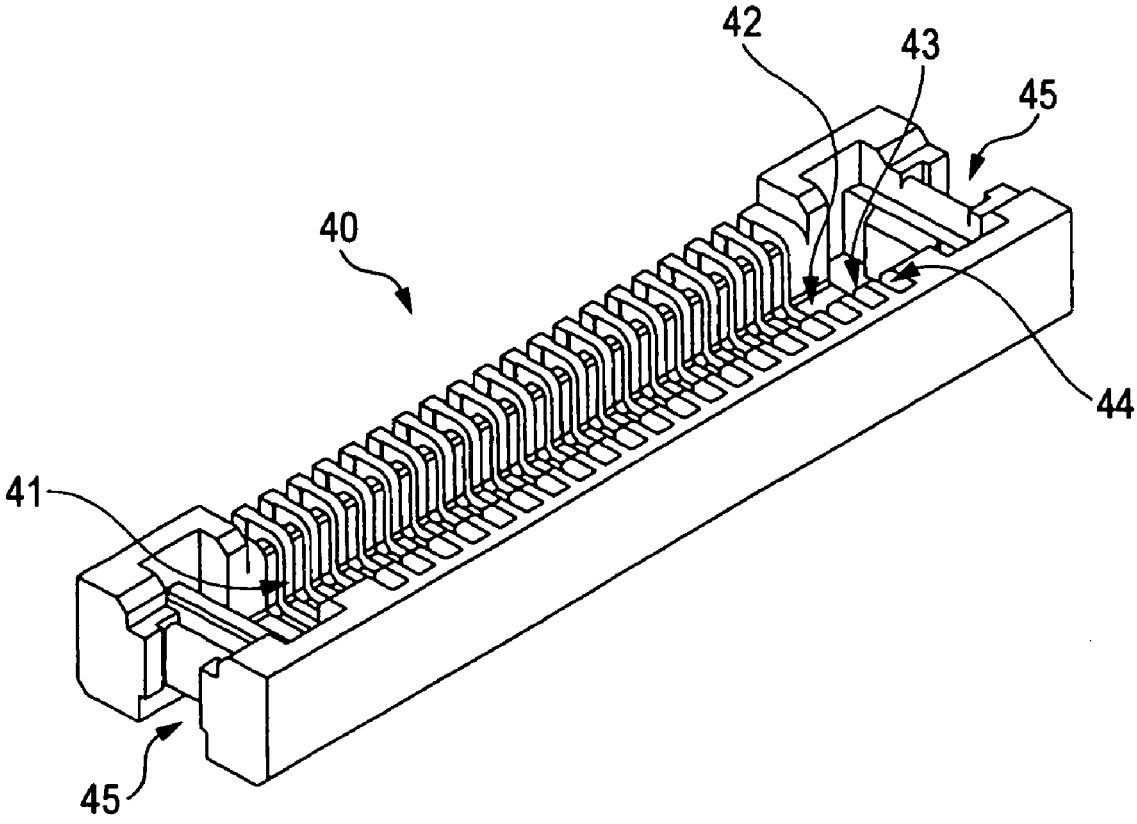
FIG. 6 is a perspective view of the socket body showing a state that socket retainers and socket contacts are removed.

As shown in FIG. 6, an elongated recess for receiving a lower portion of the plug member 1 is formed in the socket body 40, and is opened upward such that a bottom 42 of this elongated recess can be viewed from the upper side. Positioning grooves 44 for arranging the socket contacts 50 at the predetermined pitch corresponding to the arrangement pitch of the plug contacts 20 are formed in an inner face 43 of the elongated recess 41. Mounting grooves 45 are formed in the opposite ends of the socket body 40, respectively, and the socket retainer 60 are mounted in these mounting grooves 45, respectively.

Figure 7:
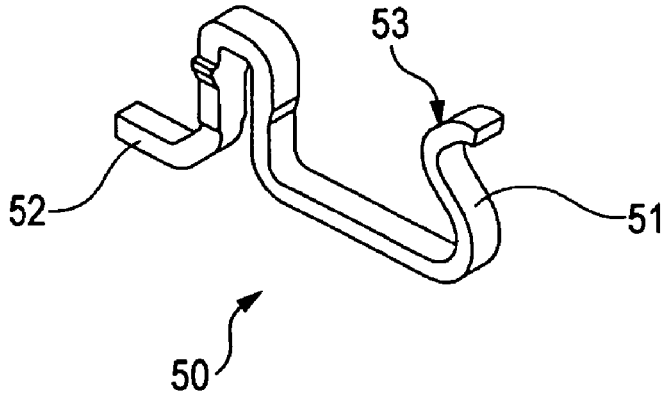
FIG. 7 is a perspective view of one of the socket contacts.

The socket contact 50 is blanked out from a thin metal sheet having good electrical conductivity and spring properties. As shown in FIG. 7, the socket contact 50 includes a resilient piece 51 and a laterally-extending tail 52. When the socket member 4 is mounted on a circuit board, the tail 52 is connected and fixed to this circuit board by soldering or the like.

Figure 8A:
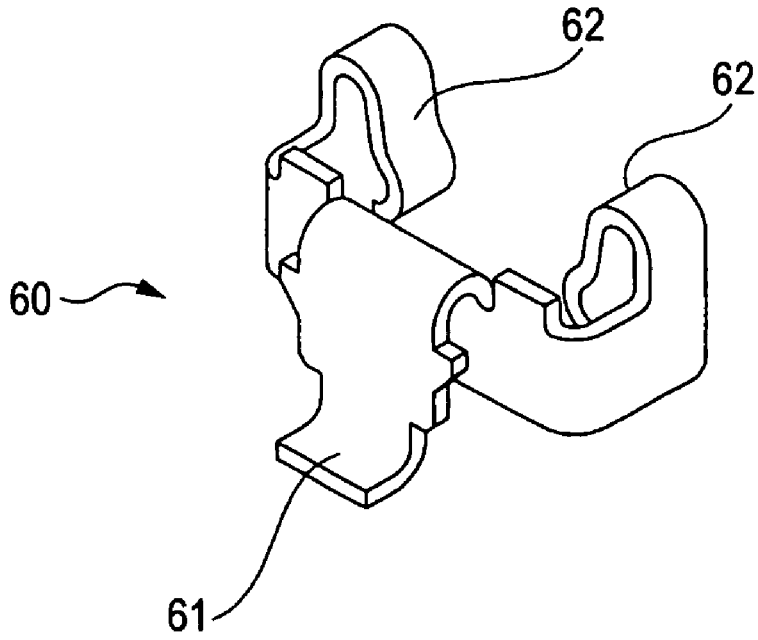
FIGS. 8A and 8B are perspective views of one of the socket retainers.
Figure 8B:
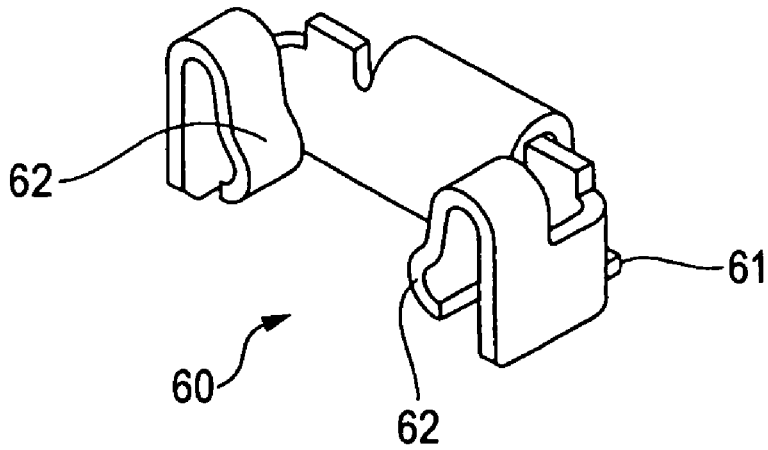

The socket retainer 60 is formed by blanking out from a thin metal sheet having electrical conductivity and then by bending it into a predetermined shape. As shown in FIGS. 8A and 8B, the socket retainer 60 includes a pair of opposed retaining pieces 62 and a laterally-extending tail 61. When the socket member 4 is mounted on the circuit board, the tail 61 is connected and fixed to this circuit board (and is electrically connected thereto if necessary) by soldering or the like. The distance between the retaining pieces 62 is so determined that they can be engaged with the extended piece 34 of the pressing member 30 when the plug member is inserted and fitted in the socket member. Preferably, the extended piece 34 can be held between the retaining pieces 62.

Figure 9A:
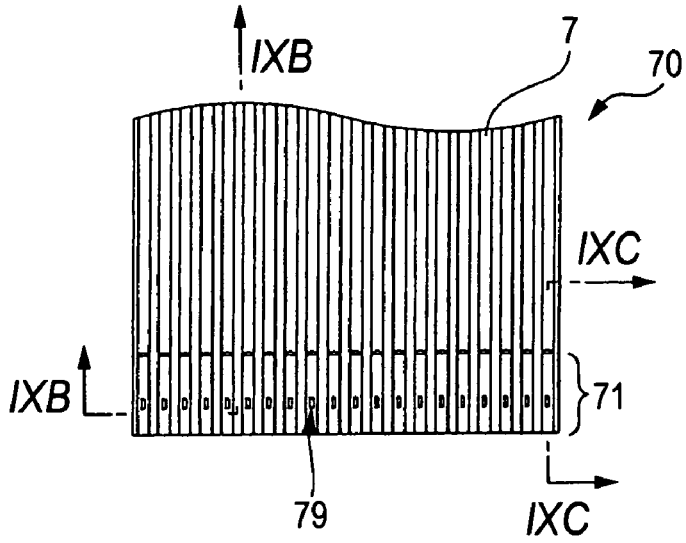
FIG. 9A is a plan view of cables to be connected to the socket body.
Figure 9B:
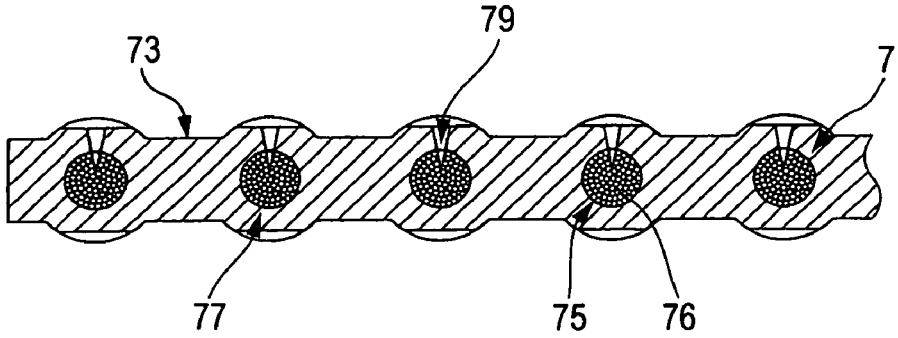
FIG. 9B is a section view taken along a line IXB—IXB in FIG. 9A.
Figure 9C:
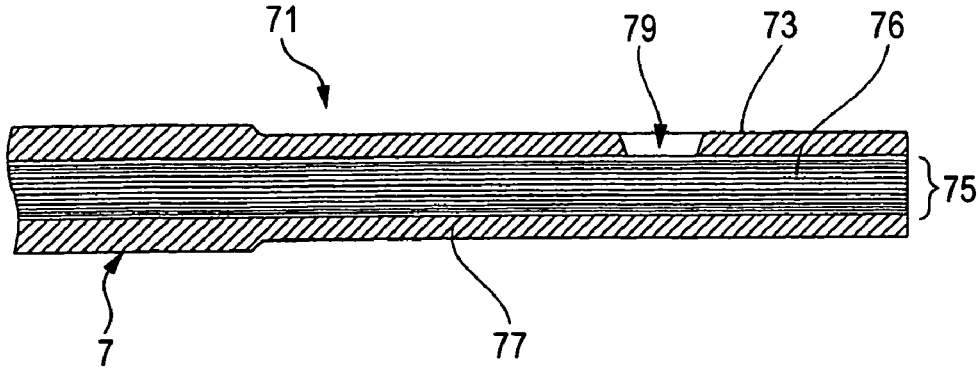
FIG. 9C is a section view taken along a line IXC—IXC in FIG. 9A.

As shown in FIGS. 9A to 9C, each of the cables 7 comprises a core conductor 75 composed of a plurality of conductive wire elements 76 such as soft copper wires twisted together, and an insulating sheath 77 made of an insulative resin material such as vinyl or a fluororesin covering the core conductor 75. A plurality of cables 7 are joined by bonding, thermal fusion or the like in such a manner that their core conductors 75 are arranged at equal intervals corresponding to the arrangement pitch of the plug contacts 20 of the plug member 1, thereby forming a flat cable 70. At an end portion 71 of the cable, the insulating sheath 77 is squeezed by hot rolling or the like in such a manner that its thickness (that is, a dimension in an upward-downward direction in FIG. 9B) is reduced, and also the insulating sheath 77 is plastically deformed to have flat faces disposed perpendicular to the direction of the thickness. A slit 79 is formed in one side 73 of each cable 7 by piercing a blade-shaped tool or the like so as to extend from the face of the insulating sheath 77 toward the center of the core conductor 75. The slits 79, formed respectively in the cables 7, are arrayed so as to face the respective first blade portions 28 of the plug contacts 20 when the end portions 71 of the cables 7 are inserted into the opening 11 of the plug body 10.

Figure 10:
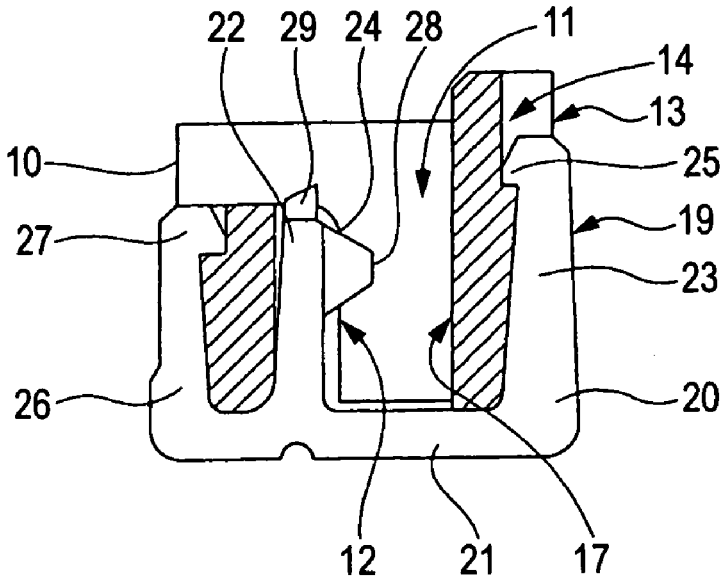
FIG. 10 is a section view of the plug body showing a state that the cables are not inserted thereto.

As shown in FIG. 10, the plug contact 20 is attached to the plug body 10 from the lower side thereof, and as a result the projection 24 of the first piece 22 projects from a first inner wall 12 of the groove 11, and also the second piece 23 is guided by the positioning groove 14 in such a manner that a portion 28 is exposed from an outer face 13, and the projection 25 of the second piece 23 and a projection 27 of the third piece 26 clamp the plug body 10. In this condition, the distance (or gap) between the first blade portion 28 and a second inner wall 17 which are opposed to each other is slightly smaller than the sum of the thickness of the end portion 71 of each cable 7 and the thickness of the vertically-extending portion 31 of the pressing member 30. The first piece 22 can be resiliently displaced in the lateral direction because of a spring function of the beam portion 21.

Figure 11:
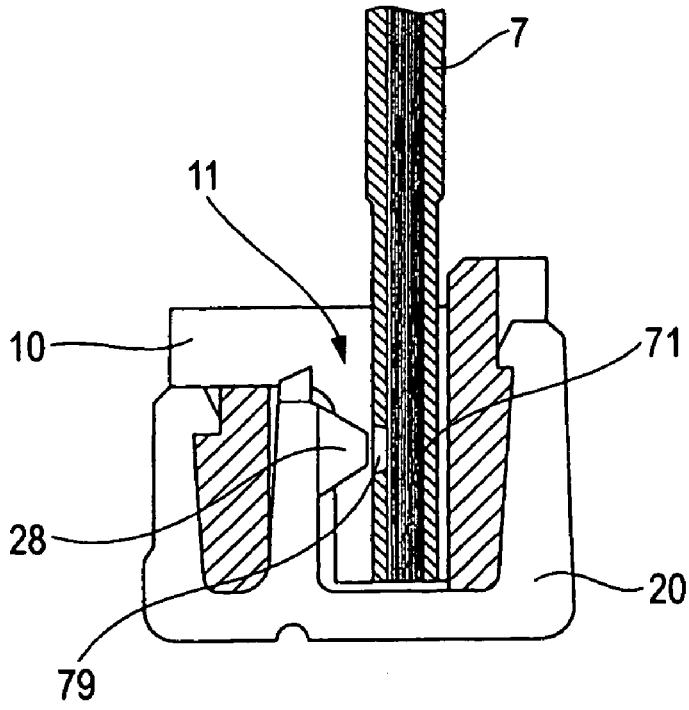
FIG. 11 is a section view of the plug body showing a state that the cables are inserted thereto.

FIG. 11 shows a condition in which the end portions 71 of the cables 7 are inserted into the plug body 10 through the opening 11 in such a manner that the slits 79 are opposed respectively to the first blade portions 28. The end portions 71 which are reduced in thickness can be easily inserted into the opening 11 even when this opening 11 has a relatively small width, and therefore the width (i.e., a dimension in the left-right direction in FIG. 11) of the plug body 10 can be made small. Hence, the electric connector can be formed into compact size.

Figure 12:
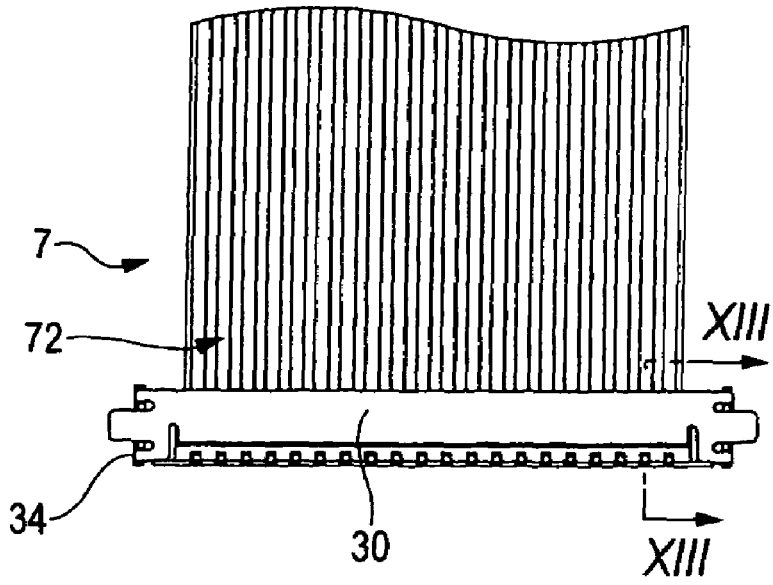
FIG. 12 is a plan view of the plug body showing a state that the cables and the pressing member are attached thereto.
Figure 13:
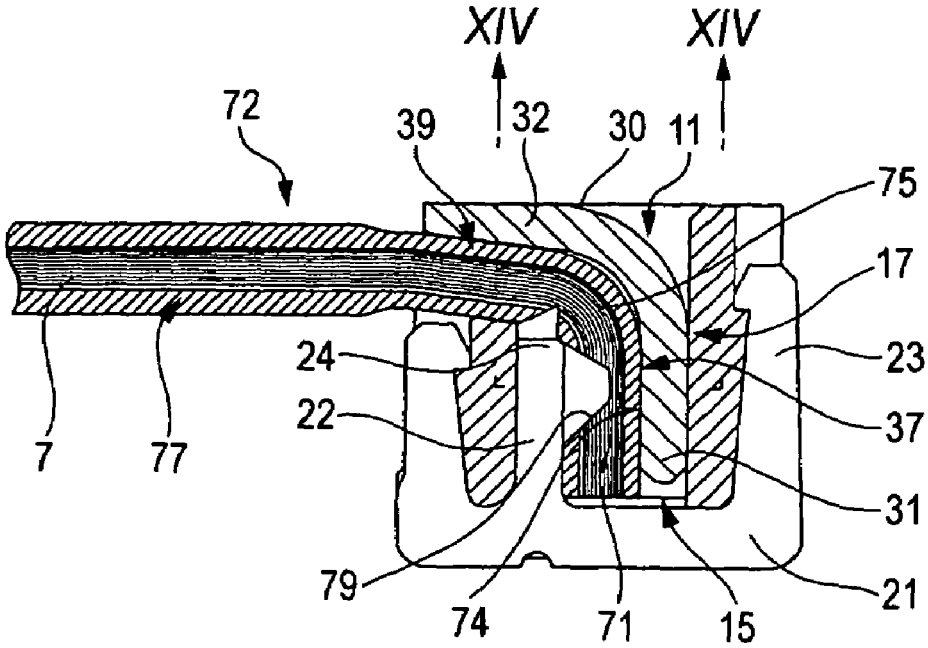
FIG. 13 is a section view taken along a line XIII—XIII in FIG. 12.
Figure 14:
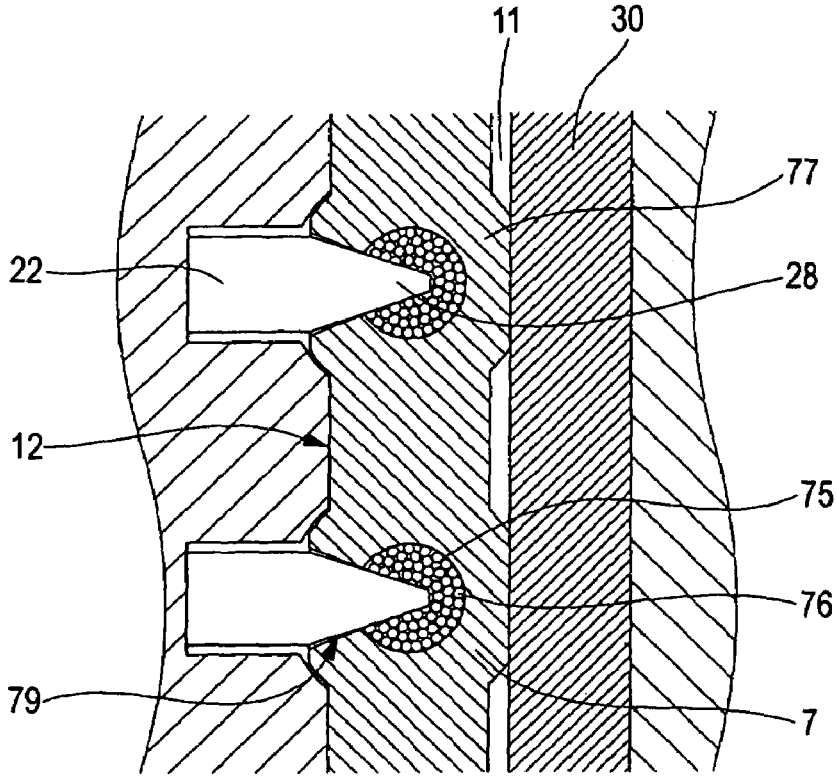
FIG. 14 is a section view taken along a line XIV—XIV in FIG. 12.

FIGS. 12 and 13 show a condition in which the end portions 71 of the cables 7 and the vertically-extending portion 31 of the pressing member 30 are inserted into the opening 11 from the upper side toward the bottom 15. The vertically-extending portion 31, which is inserted in the gap between the other side 74 of the end portion 71 of each cable 7 and the second inner wall 17 of the opening 11, presses the core conductor 75 disposed at the end portion 71 and the first piece 22 of the beam portion 21 in the lateral direction (in the left-hand direction in FIG. 13). In this condition, the end portion 71 is firmly held between the vertically-extending portion 31 and the first piece 22 with the aid of the urging effect of the second piece 23 due to the resilient spring function of the beam portion 21.

In addition, each of the first blade portions 28 is easily guided to the center of the core conductor 75 since the slit 79 is cut to extend toward the center of the core conductor 75, and bites into the vicinity of the center of the core conductor 75 through the slit 79. Since a biting load is reduced as compared with the case where the slit 79 is not provided, each of the first blade portions 28 is satisfactorily connected to a plurality of wire elements 76 (that is, the degree of contact with the wire elements 76 increases). In this condition, the core conductors 75 of the cables 7 are electrically connected to the respective plug contacts 20 without soldering.

The end portions 71 of the cables 7 are covered and bent by the laterally-extending portion 32 of the pressing member 30, and the second blade portion 29 of the first piece 22 of each plug contact 20 abuts against the inner side or face of this bent portion of the cable 7 (in biting relation to the insulating sheath 77). With this arrangement, there is achieved the function of preventing the cable 7 from being withdrawn even when an external pulling force is accidentally applied to a portion 72 extending laterally (in a left-hand direction in FIG. 13) from the end portion 71 of the cable 7. Here, when the second blade portion 29 of each plug contact 20 bites into the insulating sheath 77, and is pressed against or pierces into the corresponding core conductor 75 of the cable 7, electrical connection between the core conductor 75 and the plug contact 20 is also obtained through the second blade portion 29. And besides, the laterally-extending portion 32, disposed to partially cover the end portion 71, prevents the portion 72 of the cable 7 from being raised in the upward direction in FIG. 13.

Figure 15:
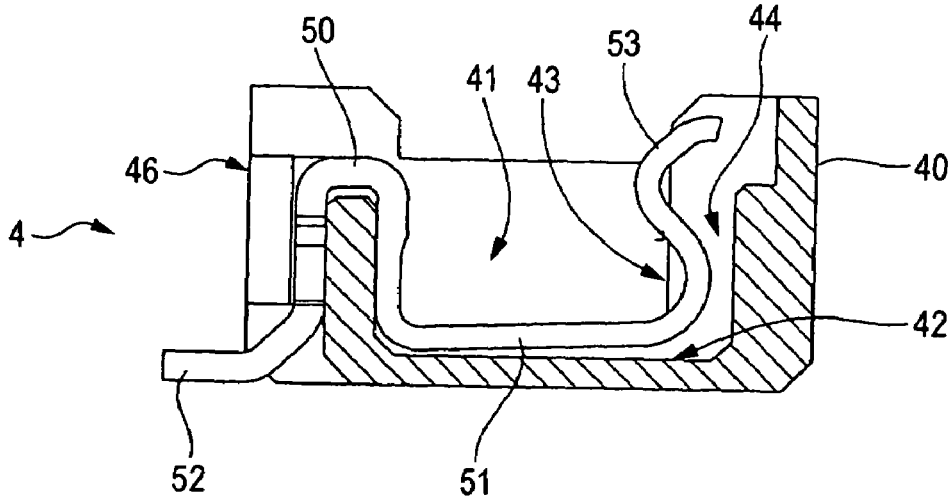
FIG. 15 is a section view of the socket body showing a state that the socket body is not fitted therein.

As shown in FIG. 15, each socket contact 50 is mounted in the socket body 40 in such a manner that a projection 53, formed at the distal end portion of the resilient piece 51, projects from an inner face 43 of the elongated recess and that the tail 52 projects from an outer face 46 of the socket body 40. In this condition, the projection 53 of the resilient piece 51 can be resiliently displaced in the lateral direction, that is, in such a direction that spreads the resilient piece 51.

Figure 16:
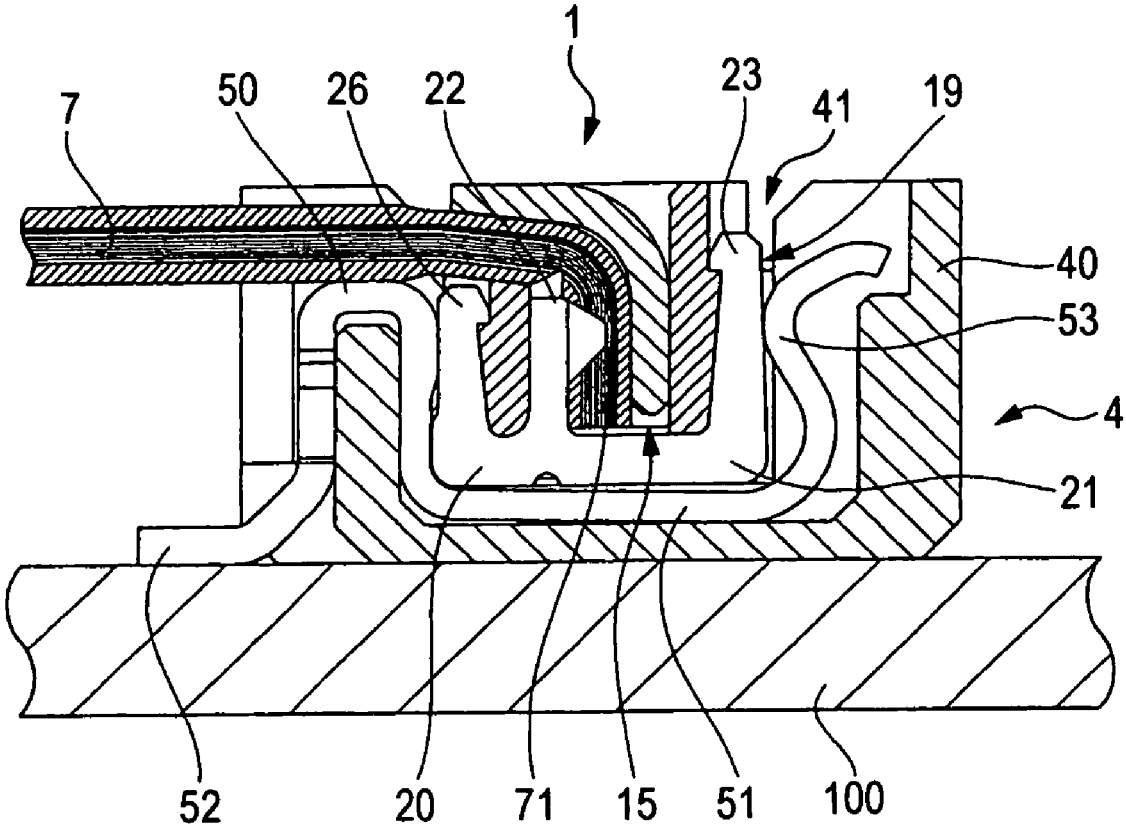
FIG. 16 is a section view of the socket body showing a state that the socket body is fitted therein.

FIG. 16 shows a condition in which the plug member 1, having the cables 7 connected thereto, is inserted and fitted into the socket member 4 mounted on a circuit board 100 having arbitrary wiring formed thereon. The plug member 1 inserted into the elongated recess 41 of the socket body 40 with the bottom 15 directed downward is fitted in the socket member 4 in such a manner that the resilient piece 51 of each socket contact 50 grips the second piece 23 and third piece 26 of the corresponding plug contact 20. In this condition, the projection 53 of the resilient piece 51, resiliently displaced in the lateral direction (in the right-hand direction in FIG. 16), presses the second piece 23 by its resilient force produced by the resilient spring function of the resilient piece 51, so that the plug contact 20 and the socket contact 50 are electrically connected together in such a manner that an exposing portion 19 and the projection 53 abut against each other. In this fitting construction in which the plug member 1 is almost completely received within the socket member 4 facilitates reduction of the height of the electric connector (from the upper face of the circuit board 100 to the top face of the plug member 1) in its completely-fitted condition. And besides, the connector mounting area can be easily provided in a space-saving manner as compared with the above-mentioned conventional example in which the mating connector is provided in a manner that it extends laterally from its connecting portion.

Here, when the insulating sheath of each cable 7 is beforehand squeezed to be plastically deformed to have a reduced thickness in the piercing direction of the first blade portion 28, the mounting space for the electric connector can be suitably reduced, and besides the height of the electric connector can be suitably reduced because of the reduced thickness of the flat cable 70 to be bent.

A method of manufacturing the end portions 71 of the cables 7 will be explained with reference to FIGS. 17A to 17C.

Figure 17A:
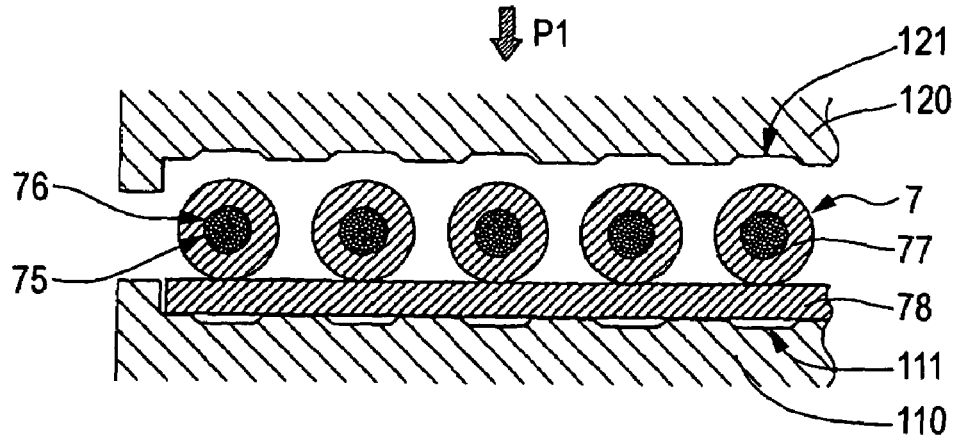
FIGS. 17A to 17C are section views showing how to manufacture the cables.

In FIG. 17A, a sheet material 78 preferably made of the same material as that of the insulating sheath 77 is placed on a first mold 110, and a plurality of cables 7 are arranged on the sheet material 78 in such a manner that their core conductors 75 are arranged at the predetermined pitch. The first mold 110 has recesses 111 which are formed in an upper face thereof, and are arranged at a pitch corresponding to the pitch of the core conductors 75. A second mold 120 is located above the first mold 110, and can be pressed down or moved downward in a direction P1. The second mold 120 has recesses 121 which are formed in a lower face thereof facing the upper face of the first mold 110, and are arranged at a pitch corresponding to the pitch of the core conductors 75.

A heater such as an electric heater (not shown) is provided in at least one of the fixing member 110 and the second mold 120. The cables 7 and the sheet material 78 are held between the first mold 110 and the second mold 120 in a squeezed manner, and are formed or molded into a generally flattened shape with the aid of a heating effect of the heater in such a manner that the insulating sheaths 77 and the sheet material 78 are fused as shown in FIG. 17B. In this condition, the distance between bottom faces of each mating pair of recesses 111 and 121 is so determined that the thickness of that portion of the molded flattened portion between these bottom faces is smaller than the outer diameter of the sheath of the cable 7 which is not yet squeezed. In the next step, when the second mold 120 is moved upward, the thin multi-core conductor cable, having the core conductors 75 arranged at the predetermined pitch, remains on the first mold 110.

Figure 17B:
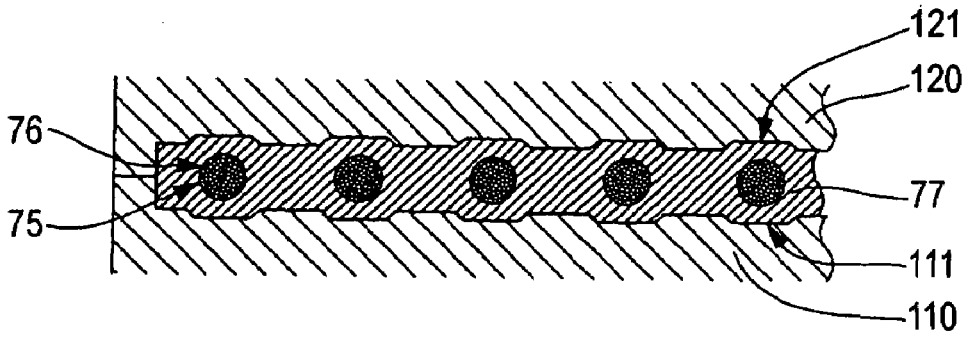
Figure 17C:
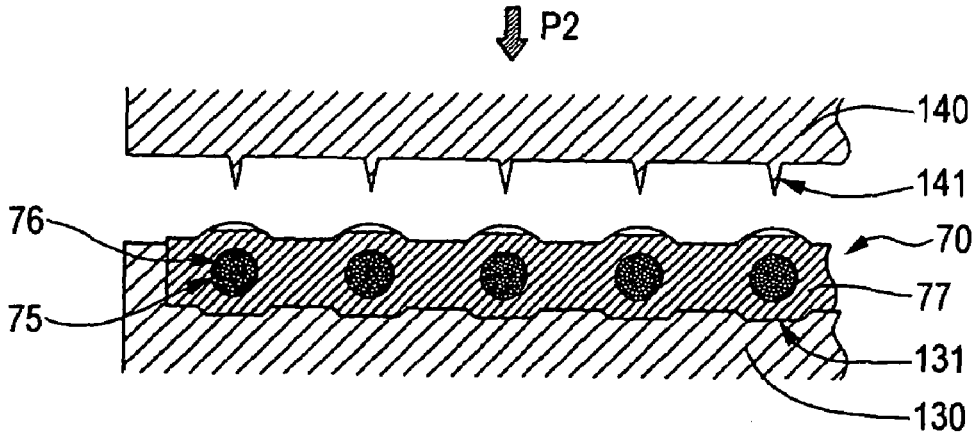

As shown in FIG. 17C, the flat cable 70 which has been formed into the flattened shape through the steps of FIGS. 17A and 17B is placed on an upper face of a third mold 130 in such a manner that the core conductors 75 are disposed right above respective recesses 131. A fourth mold 140 is located above the third mold 130 and can be moved downward in a direction P2. The fourth mold 140 has blade-shaped portions 141 which are formed on a lower face thereof facing the upper face of the third mold 130 and are arranged at a pitch corresponding to the pitch of the core conductors 75. A length of projecting of each blade-shaped portion 141 and the amount of pressing-down (that is, the amount of downward movement) of the fourth mold 140 are so determined that when the pressing-down operation is finished, the distal end portion of the blade-shaped portion 141 cuts into the insulating sheath 77, and further bites into the vicinity of the center of the core conductor 75. With this construction, when the fourth mold 140 is moved upward in the next step (not shown), it will be observed that the slits 79 each of which has an upward opening are formed in the flat cable 70.

In the above embodiment, although the pressing member 30 is made of the thin metal sheet, it can be made of a synthetic resin or the like, and further its cross-sectional shape, defined by the vertically-extending portion 31 and the laterally-extending portion 32, is not limited to the generally inverted L-shape, but can take any other suitable shape such as a generally T-shape in so far as the pressing member 30 can have desired rigidity.

As to the form of the flat cable 70, the outer periphery of each insulating sheath 77 is not limited to an arcuate shape, but can take any other suitable shape in so far as a plurality of core conductors 75 are juxtaposed in parallel relation to each other. Further, the flat cable can take a form in which core conductors 75, having different cross-sectional areas (for example, in accordance with the value of electric current to be supplied thereto) are juxtaposed in a mixed manner.

Further, the method of manufacturing the flattened cable is not limited to the thermal fusion method shown in FIGS. 17A and 17B, but any other suitable method, such as an ultrasonic fusion method, an extrusion method and an injection method, can be used. Further, as the method in which the thickness of the end portion 71 of each cable 7 is reduced, there can be used any suitable method such as a method of plastic deformation by a pressing operation involving the heating, a method of plastic deformation by a pressing operation not involving the heating, and a method involving thermal fusion. Further, the formation of the slits 79 does not always need to be performed at the step (as shown in FIG. 17C) subsequent to the step of forming the flattened cable 70, but the formation of the slits 79 can be performed in the step in which the flattened cable is formed.

Further, although each plug contact 20 has the single first blade portion 28, the plug contact 20 can have a plurality of first blade portions, in which case the number of the slits 79 for each cable 7 can be increased accordingly.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An electric connector, comprising:

a plug member, adapted to be fitted into a socket body in a first direction, the plug member comprising:

a plug body, formed with a groove extending in a second direction which is perpendicular to the first direction; and a plurality of plug contacts, each of which includes a first contact piece and a second contact piece which are opposed to each other with a gap therebetween, and a first blade portion extended from the first contact piece so as to oppose to the second contact piece, the plug contacts being arrayed in the second direction such that the first contact piece is disposed in the groove and the second contact piece is disposed on an outer face of a side wall of the plug body to be electrically connected with the socket body;

a wiring member, having a plurality of core conductors arrayed in the second direction and covered with an insulating sheath, the wiring member including a first portion adapted to be inserted into the groove in the first direction; and a pressing member, having a first part extending in the first direction, and attached to the plug body such that the first part is inserted into the groove, thereby pressing the first portion of the wiring member against the first contact piece in a third direction which is orthogonal to the first direction and the second direction, wherein the first contact piece and the second contact piece are resiliently deformable in the third direction, so that each first blade portion bites into an associated one of the core conductors in the first portion of the wiring member, and the first portion of the wiring member is resiliently clamped between the first contact piece and the first part of the pressing member.

2. The electric connector as set forth in claim 1, wherein:

the pressing member has a second part continued from the first part thereof and extending in the third direction; and the wiring member includes a second portion adapted to be bent by the second part of the pressing member so as to extend in the third direction.

3. The electric connector as set forth in claim 2, wherein each first contact piece includes a second blade portion extending in the first direction and adapted to bite into associated one of the core conductors in the second portion of the wiring member.

4. The electric connector as set forth in claim 1, wherein a thickness of the first portion of the wiring member is reduced.

5. The electric connector as set forth in claim 3, wherein a thickness of the first portion and the second portion of the wiring member is reduced.

6. The electric connector as set forth in claim 1, wherein the first portion of the wiring member is formed with slits each of which is adapted to oppose the first blade portion when the first portion of the wiring member is inserted into the groove.

7. The electric connector as set forth in claim 1, wherein at least a part of the first portion of the wiring member which opposes the first blade portion is made flat.

8. An electric connector, comprising:

a plug member, adapted to be fitted into a socket body in a first direction, the plug member comprising:

a plug body, formed with a groove extending in a second direction which is perpendicular to the first direction; and a plurality of plug contacts, each of which includes a first blade portion, the plug contacts being arrayed in the second direction such that each first blade portion is disposed in the groove;

a wiring member, having a plurality of core conductors arrayed in the second direction and covered with an insulating sheath, the wiring member including a first portion adapted to be inserted into the groove in the first direction; and a pressing member, having a first part extending in the first direction, and attached to the plug body such that the first part is inserted into the groove, thereby pressing the first portion of the wiring member against the first blade portion in a third direction which is orthogonal to the first direction and the second direction, so that each first blade portion bites into an associated one of the core conductors in the first portion of the wiring member, wherein a thickness of the first portion of the wiring member is reduced;

wherein the pressing member has a second part continued from the first part thereof and extending in the third direction; and the wiring member includes a second portion adapted to be bent by the second part of the pressing member so as to extend in the third direction.

9. The electric connector as set forth in claim 8, wherein the first portion of the wiring member is formed with slits each of which is adapted to oppose the first blade portion when the first portion of the wiring member is inserted into the groove.

10. The electric connector as set forth in claim 8, wherein at least a part of the first portion of the wiring member which opposes the first blade portion is made flat.

11. The electric connector as set forth in claim 8, wherein each of the plug contacts includes a second blade portion extending in the first direction and adapted to bite into associated one of the core conductors in the second portion of the wiring member.

12. The electric connector as set forth in claim 8, wherein a thickness of the first portion and the second portion of the wiring member is reduced.

* * * * *